US005639149A

United States Patent [19]

Grassmuck

[11] Patent Number: 5,639,149

[45] Date of Patent: Jun. 17, 1997

[54] GLASS FRONT MERCHANDISER WITH INVISIBLE HINGE AND SEALS

[75] Inventor: Michael D. Grassmuck, Mexico City, Mexico

[73] Assignee: Hussmann Corporation, Bridgeton, Mo.

[21] Appl. No.: 57,980

[22] Filed: May 4, 1993

[51] Int. Cl.[6] ..... A47F 3/04

[52] U.S. Cl. ..... 312/116; 312/139; 312/319.2; 49/371; 49/383; 277/226

[58] Field of Search ..... 312/116, 138.1, 312/139, 319.2, 319.3; 49/40, 368, 371, 383, 386; 52/64, 69; 277/201, 202, 226

[56] References Cited

U.S. PATENT DOCUMENTS

| | | | |
|---|---|---|---|
| 2,654,421 | 10/1953 | Blanchard | 49/371 |
| 2,912,727 | 11/1959 | Sehn | 49/371 |
| 3,161,925 | 12/1964 | Bertolini | 49/368 |
| 4,185,415 | 1/1980 | LaConte | 49/386 |
| 4,288,135 | 9/1981 | Buchser et al. | 49/368 |
| 4,753,043 | 6/1988 | Bockwinkle . | |
| 4,842,349 | 6/1989 | Stenemann | 312/116 |
| 4,998,382 | 3/1991 | Kostos et al. . | |
| 5,111,618 | 5/1992 | Kaspar et al. . | |
| 5,116,274 | 5/1992 | Artwohl et al. . | |
| 5,138,804 | 8/1992 | Roberts . | |
| 5,207,490 | 5/1993 | Kaspar et al. | 312/139 |

FOREIGN PATENT DOCUMENTS

| | | | |
|---|---|---|---|
| 2482909 | 11/1981 | France | 312/139 |
| 3503340 | 8/1986 | Germany | 312/116 |
| 1121249 | 7/1968 | United Kingdom | 49/368 |

*Primary Examiner*—Edward K. Look
*Assistant Examiner*—Christopher Verdier
*Attorney, Agent, or Firm*—Richard G. Heywood

[57] ABSTRACT

A glass front merchandiser having a refrigerated cabinet with a product zone normally closed by a glass front panel having a hinging side margin, the glass front panel including an outer glass pane and a structural frame member secured adjacent to the peripheral edge thereof along its hinging side margin, a hinge directly connected to the structural frame member and being constructed and arranged for hinging movement of the glass front panel on the refrigerated cabinet to open up the product zone, the outer peripheral edge of the structural frame member overhanging the hinge in a closed sealing position of the glass front panel with the merchandiser cabinet, and other seals constructed and arranged along the side margins of the glass front panel.

50 Claims, 5 Drawing Sheets

GLASS FRONT MERCHANDISER WITH INVISIBLE HINGE AND SEALS

FIELD OF THE INVENTION

The present invention relates generally to the commercial food merchandising art, and more particularly to refrigerated or heat controlled food merchandisers having front access openings closed by hinged glass panels.

BACKGROUND OF THE INVENTION

Various styles of refrigerated and hot food merchandisers are used in supermarkets and other food stores for the display and storage of food products, including the type that employ hinged or pivoted glass front door or window panels for accessing the interior product zone of the merchandiser cabinet. Typically, such a glass panel comprises an insulated glass unit consisting of two or more glass panes that are sealed in spaced relation, and the unit is hinged to the cabinet frame for vertical opening movement on a horizontal axis or for side opening movement on a vertical axis. Insulated dual-glass units or the like are energy efficient in the operation of the merchandiser, but are relatively heavy and require sturdy and rugged cabinet framing and hinged mountings to support the weight of the glass unit and withstand various forces exerted thereon through continuous opening and closing usage. In longer merchandiser cabinets or multiple cabinet line-ups, it is accepted practice to use plural side-by-side front glass panels that are supported at their adjacent edges by intermediate supporting ribs or frame members. In commercial merchandisers, the finished appearance of the glass front unit is of high importance in enhancing the display and sale of the food products, and intermediate structural ribs block the view of the product zone and interfere with the free access to the interior for stocking and servicing the merchandiser case.

In the past, glass front panels have employed peripheral metal support frames to add strength to the outer edges of the glass panes and facilitate hinged mounting of the units. In refrigerated cabinets, such door or window panels generally require electrical heaters and other insulation to obviate condensation build-up on such framing and moisture migration and clouding between the glass panes. Also, the exposure of large hinges has been esthetically displeasing, and even the use of protective framing at the peripheral edges of the glass units detracts from the appearance.

Artwohl et al U.S. Pat. No. 5,116,274 discloses a deli-style merchandiser that approaches some of the prior art problems of a glass front unit, but uses a two-piece metal clamp that extends along the upper marginal edge of the double glass window panel and clamps across both glass surfaces at the outer peripheral glass margins. The outer exposed metal clamp member is enlarged to cover the hinging space between the glass unit and the cabinet.

Kaspar et al U.S. Pat. No. 5,111,618 and its parent U.S. Pat. No. 4,998,382 disclose a reach-in type merchandiser that purports to overcome a prior art styling problem of glass front units to achieve a more "Continental" look. Thus, a peripheral masking on the outer glass pane obscures the underlying metal support frame, but the frame still extends outwardly around the outer glass periphery and is a visible presence.

Bockwinkle U.S. Pat. No. 4,753,043 also discloses a reach-in merchandiser that utilizes a structural foam framing edge for a glass unit in lieu of an exposed metal frame to thereby obviate condensation problems, and also utilizes a conventional top and bottom door pivoting arrangement.

DESCRIPTION OF THE INVENTION

The invention is embodied in a temperature controlled product display merchandiser having an open front cabinet with an interior refrigerated product zone normally closed by a glass front unit having one hinging side margin, the glass front unit including an outer glass pane and a structural frame member secured in inwardly spaced relation to the peripheral edge of the outer glass pane along the one side margin, sealing means carried by the glass front unit, and hinge means rigidly connected to the structural frame member and being pivotally connected to the cabinet to provide hinging opening movement of the glass front unit to access the interior product zone, the peripheral edges of the outer glass pane being constructed and arranged to cover and obscure the hinge means and the sealing means.

A principal object of the present invention is to provide improved hinge devices for the movable glass unit of a glass front merchandiser, and accommodate esthetic enhancements to achieve a substantially "all glass" appearance.

Another object is to provide an improved heavy duty structure hinge for a glass front food merchandiser that supports the peripheral glass at the hinging side without exerting any opposed clamping pressures thereon.

Another object is to provide an improved glass front unit for a food merchandiser having an outwardly unframed "all glass" appearance, and enhanced peripheral masking features to blend at least the hinging side of the glass panel with the adjacent cabinet structure and obscure the underlying hinge and framing components.

Another object is to provide a strong and rugged novel hinge construction for pivotally mounting a dual glass unit in a refrigerated or heated merchandiser cabinet.

Another object is to provide a glass front merchandiser having plural glass front panels without requiring intermediate support structure therefor.

Still another object is to provide novel sealing means for sealably engaging between the margins of adjacent glass panels.

Another object is to provide a temperature controlled merchandiser having a thermal dual-glass front unit hingedly mounted for opening and closing movement without exerting stress forces on the glass panels and providing an optimum esthetic appearance.

These and still other objects and advantages will become more apparent hereinafter.

BRIEF DESCRIPTION OF THE DRAWINGS

In the accompanying drawings, wherein like numerals refer to like parts wherever they occur.

DESCRIPTION OF THE PREFERRED EMBODIMENTS

Figure 1:
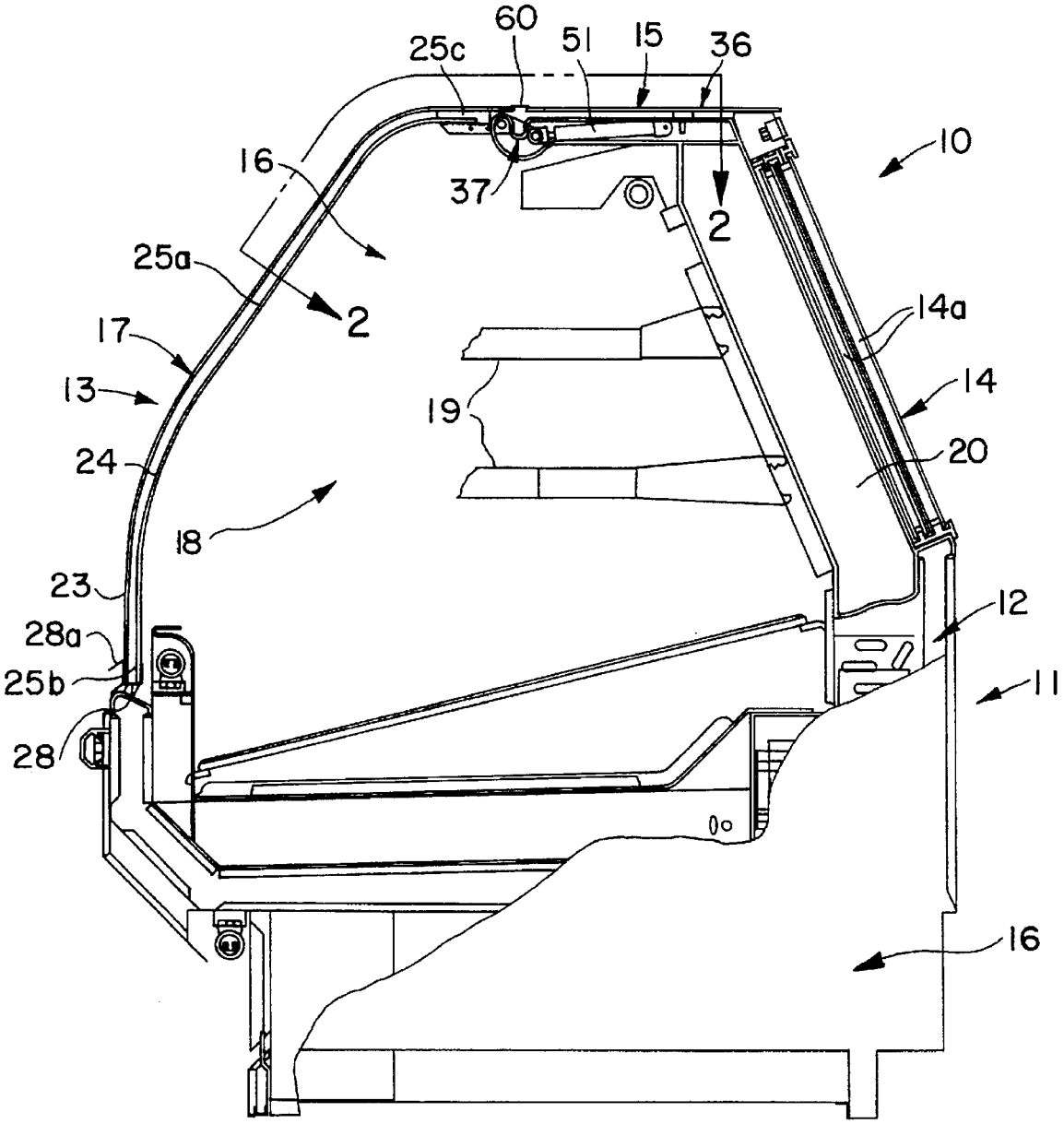
FIG. 1 is a side elevational view, partly in section, illustrating one application of the present invention in a glass front deli-type refrigerated merchandiser.

Referring to FIGS. 1–7, the invention is disclosed in a presently preferred embodiment in a deli-type display merchandiser 10 used in the refrigerated showcasing of fresh meats, fish, cheese and other non-frozen products within the normal commercial temperature range of about 28° F. to 40° F. The merchandiser 10 of FIG. 1 exemplifies a popular Continental or European styling in configuration, particularly in the double curved front glass unit to be discussed. It will be understood that the same basic merchandiser cabinet configuration about to be described in more detail can be utilized in the showcasing and sale of hot foods in a temperature controlled environment of about 150° F. The merchandiser 10 basically comprises a cabinet having a lower base section 11 housing conventional refrigeration (or heating apparatus) and air circulation means 12 and an upper product display section 13. The upper cabinet section 13 has a sloping rear service wall 14 that typically is constructed and arranged to provide sliding access service doors 14*a*, a short horizontal top wall 15, end walls 16 and the double-curved glass front panel 17 conforming generally to the configuration of the end wall front margin and which all together define the refrigerated product display zone 18 having shelf means 19 therein. The lower section 11 and the rear, top and end walls of the upper section 13 will be insulated as needed to maintain optimum refrigerated or heated thermal conditions in the display area 18.

A principal feature of the invention is to provide a solid support for the hinging of the glass front unit 17 and, to that end, the rear wall 14 includes rigid structural support struts 20 that extend vertically from the top wall 15 down through the base of the lower section 11. It will also be clear that, in the FIG. 1–7 form of the invention, the glass front unit 17 is mounted for vertical upward opening movement on hinge means 22 located at the upper margin of the panel 17 and front margin of the top wall 15.

The glass front panel 17 of the preferred embodiment comprises a multiple glass pane unit formed of a pair of complementary curved glass panes—an outer pane 23 exposed to ambient and an inner pane 24 exposed to the display zone 18—which extend in parallel spaced apart relationship. The panes 23 and 24 are formed into the panel 17 using state of the art spacing and sealing means, generally indicated at 25, and state of the art assembly techniques to thereby assure a sealed moisture free, insulating air space 26 between the panes 23 and 24. For instance, as shown best in FIGS. 5 and 6, the spacing and sealing means 25 preferably include vertically curved side spacer bar members 25*a*, a lower horizontal spacer bar member 25*b* and an upper horizontal spacer bar member 25*c*, that are joined together to form a frame. It is important to note that the side and lower spacing bar members 25*a* and 25*b* are recessed slightly inwardly of the respective peripheral marginal edges (27) of the outer glass pane 23 and a sealant 25*d* is provided to coat the outer side of the bars 25*a* and 25*b* and form a moisture seal. In addition to the spacing and sealing means 25, it is known to use a moisture absorbing desiccant (not shown) in the dry air space 26 to obviate fogging conditions. With reference to FIG. 1, it will be noted that the glass front panel 17 is provided at its lower horizontal margin with a U-shaped sealing channel 28 to sealably seat the lower margin on the front wall of the lower base section 11, and the channel 28 may include a handle 28*a* for controlling the raising and lowering of the panels 17. As will be more fully described, the closed position of the curved front glass panels is determined by the hinging means 22 and the lower margin seating, and the glass panels 17 carry their own side margin sealing means 34.

Figure 2:
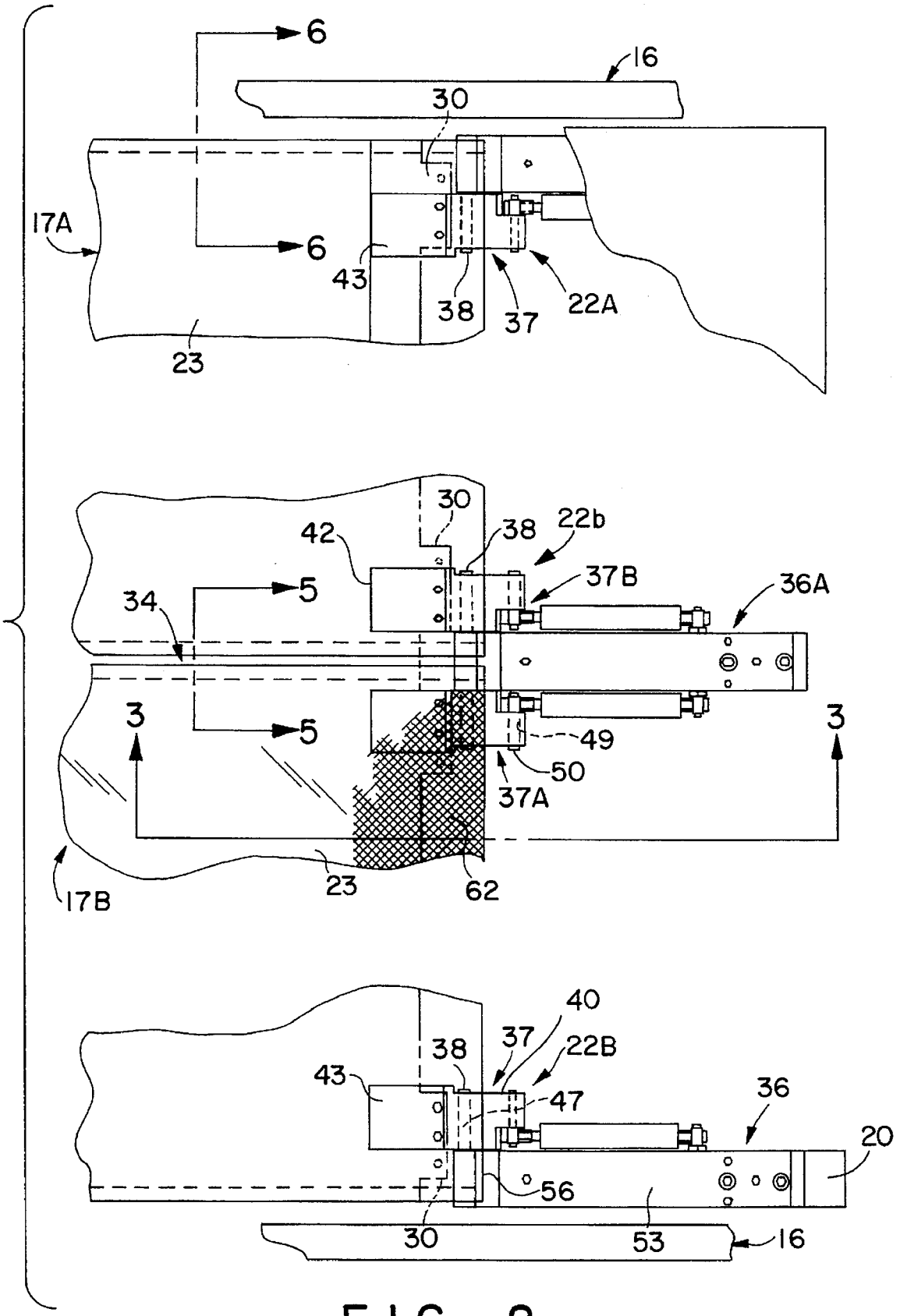
FIG. 2 is an enlarged fragmentary plan view taken substantially along line 2—2 of FIG. 1.
Figure 3:
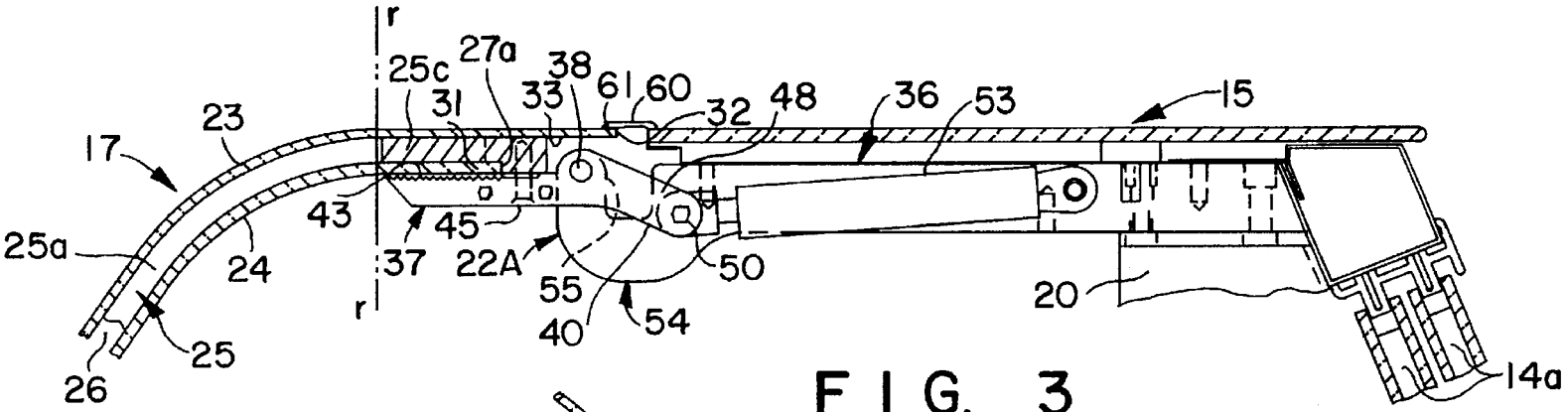
FIG. 3 is an enlarged sectional view taken along line 3—3 of FIG. 2, and showing the invention in the closed position of the glass front unit.
Figure 4:
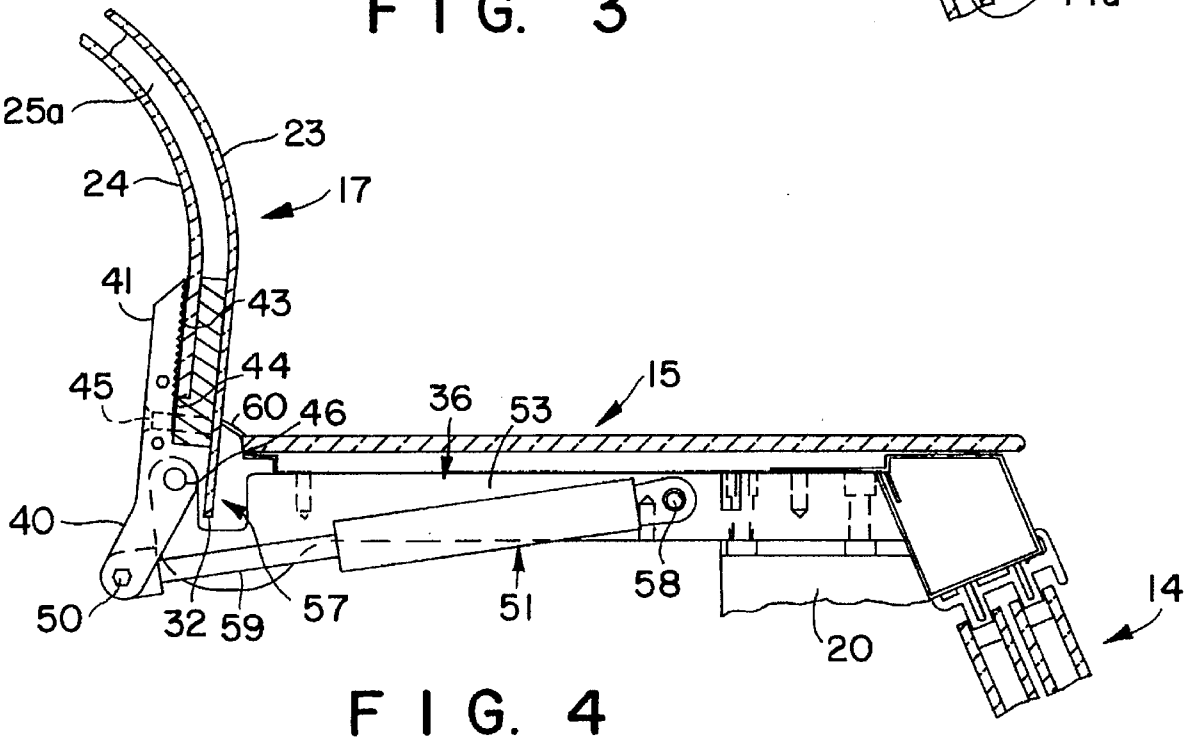
FIG. 4 is a view similar to FIG. 3, but showing the open position of the glass front unit.

Referring particularly to FIGS. 2–4, a feature of the invention is that upper spacer block 25*c* of the spacing and sealing means 25 also functions as a solid structure member in combination with hinge means 22. The upper spacer member 25*c* (and the other spacers) is a solid bar of aluminum or the like providing relatively light weight structural integrity, and it extends along the upper margin of the panel 17 substantially the entire width of the panel. The upper spacer member 25*c* has an inner spacer and support portion or section that is an integral part of the spacing and sealing means 25 between both the outer and inner glass panes 23 and 24, and it also has an enlarged outwardly extending structural and attachment portion or section 30 that connects to the inner section 25*c* with a shoulder 31 to seat the upper marginal edge 27*a* of the inner panel 24. The outer spacer bar section 30 extends beyond the inner glass pane 24, but is inwardly of the outer or upper marginal edge 32 of the outer glass pane 23 a predetermined distance as indicated by the overhang or outer pane extension portion 33. It will also be seen that the upper spacer bar member 30 is a solid bar of generally rectangular cross-section except for the stepped inner surface accommodating the thickness of the inner glass pane 24 and forming the inner spacer section 25*c*. The cross-dimension (width) of the upper spacer bar 30 (transverse to the lengthwise linear horizontal dimension of the panel 17) is preselected so that the inner spacer section 25*c* extends substantially to the start of the downward radius curve r—r of the glass panes 23 and 24, as shown in FIG. 3. This provides a maximum lateral support area for attachment of the hinging means 22 of the invention.

Glass front merchandisers 10 of the deli-type are frequently set up in supermarket arrangements employing two or more merchandisers in open end-to-end relationship without intermediate end walls, so that a sixteen foot line-up of two eight foot cases or the like would only have two end walls 16 at extreme outer ends. Most of these merchandisers are sized in eight foot or twelve foot lengths, and it is usual industry practice to form the glass front panels 17 into four foot sections (17A and 17B in FIG. 2) due to the weight. Heretofore, it has also been usual to use relatively light weight hinges and locking means for the raised or opened position of the panels, while providing intermediate (lengthwise) curved structural ribs at the location of the adjacent vertical panel edges to sealably seat and support the glass panels in their closed position. A feature of the invention is to eliminate such structural ribs so that the interior product zone 18 will be wide open and unobstructed between the outer end walls 16.

Figure 5:
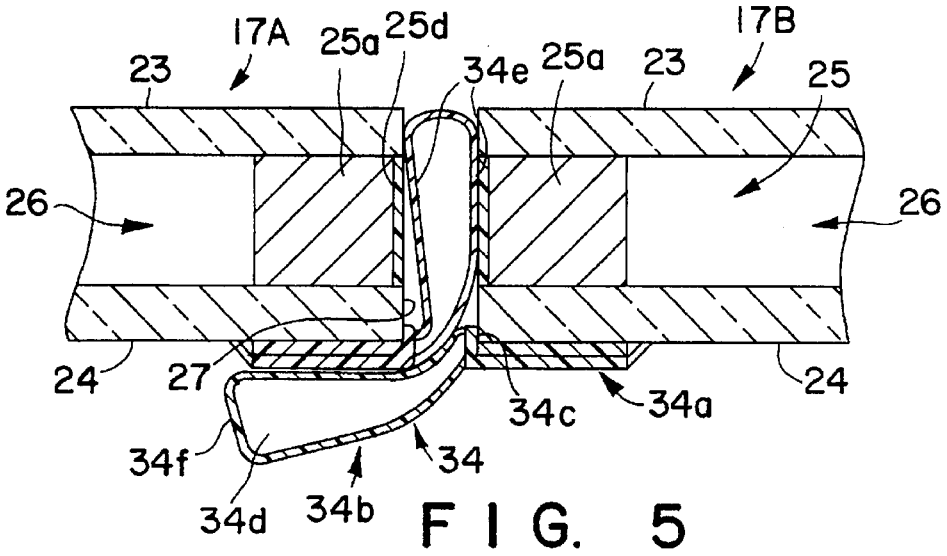
FIG. 5 is a greatly enlarged fragmentary sectional view showing the sealing means of the invention as taken on line 5—5 of FIG. 2.
Figure 6:
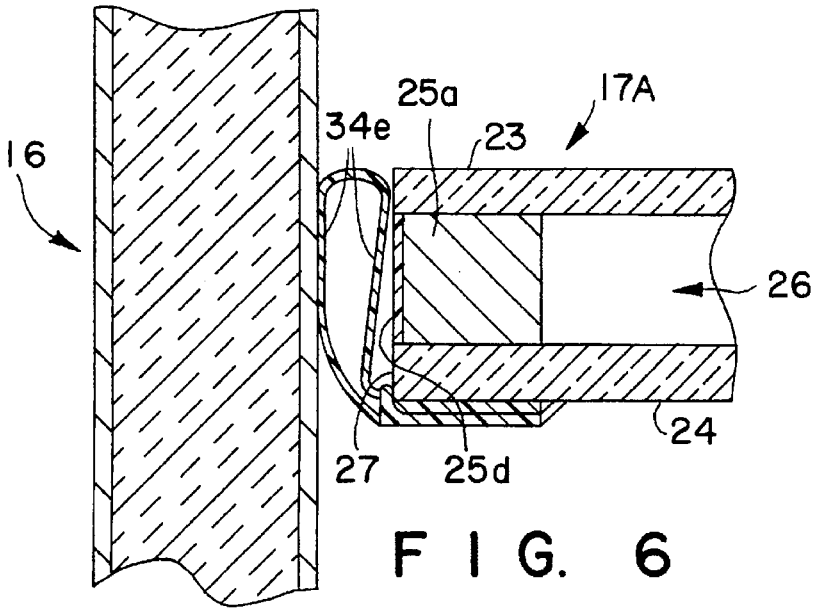
FIG. 6 is another enlarged fragmentary section of the sealing means taken at line 6—6 of FIG. 2.
Figure 7:
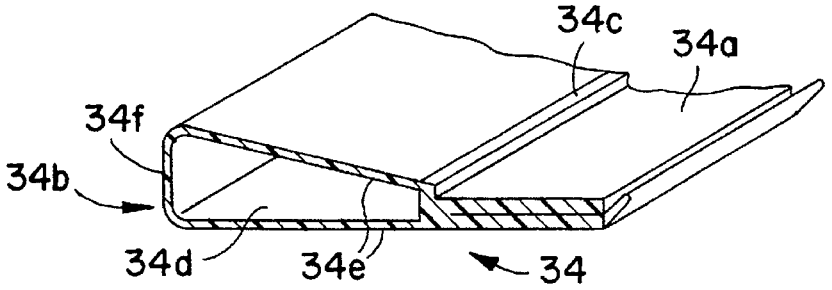
FIG. 7 is a greatly enlarged fragmentary section showing the sealing means of FIGS. 5 and 6 alone.

Referring to FIG. 5, a novel dual sealing means 34 is constructed and arranged to extend between the adjacent vertically curved edges of glass panels 17A and 17B to provide sealed refrigeration integrity to the product zone 18 during the normal closed operating position of the panels. In a preferred form shown best in FIG. 7, the sealing means 34 is extruded from a resilient material and has a relatively thick and firm base portion 34*a* and a relatively thin and pliable seal portion 34b connected by return portion 34c. The seal portion 34b in its extruded form is generally wedge-shaped with a hollow interior cavity 34d defined by opposed side walls 34e widening out or diverging from the return portion 34c to a outer closure wall 34f. Referring again to FIG. 5, the sealing means 34 is secured to the adjacent vertically curved interior margins of the inner glass pane 24 by adhesively affixing the base portion 34a so that the return 34c laps the peripheral edge 27 and the seal portion 34b would normally extend outwardly substantially parallel to the plane of the inner glass pane 24. In the dual seal arrangement of FIG. 5, the double sealing means 34 extend toward each other from the opposite adjacent glass margins. However, in operation, one of the glass panels (17B) will be closed and seated on the merchandiser cabinet first with its seal portion extending outwardly and, as the other adjacent glass panel (17A) is moved to a closed position next to the first panel, its outwardly extending seal member 34b will then be bent and the side walls 34e compressed to form a primary seal between the panel edges 27. In the fully closed position, the seal portion 34b of the first panel (17B) will be contacted by the primary seal base portion 34a to divert the flexible seal walls inwardly and sealably therewith. The seals will work in reverse or "flip-flop" fashion depending on which panel is closed first. Now referring to FIG. 6, the same sealing means 34 is used to engage the end wall 16 at the extreme vertically curved outer marginal edges 27 of the glass panels 17. As the glass panel is opened, the flexible seal portion 34b will unfold or extend to an outwardly extending position; and will again be turned up and compressed as the glass front panel 17 transites to a fully closed and sealed position. The end wall 34f, in any case, will become bowed outwardly to a rounded form, and the sealing means is constructed and arranged so that the end wall portion 34f does not extend outwardly beyond the plane of the outer glass pane 23. Thus, the end-to-end lineup of merchandisers 10 will present a substantially continuous all-glass appearance.

The hinge means 22 of the invention will typically utilize a pair of hinge assemblies for each glass panel 17 including a left-hand assembly 22A and a right-hand assembly 22B. Only one such assembly will now be described with reference to FIGS. 2–4. Each hinge assembly 22 comprises a hinge bracket member 36 rigidly secured to a strut 20 of the cabinet frame, and a hinge member 37 secured to the glass front panel 17 and pivotally mounted on the hinge bracket 36 by a hinge pin 38. The hinge member 37 comprises a back or rearwardly projecting hinge and control section 40 and a front or forwardly projecting support and attachment section 41. The front section 41 has a wide hinge plate portion 42 with an upper glass-engaging support surface 43 that is ribbed, serrated, knurled or the like to define a wide area support for engagement with the inner glass pane 24 without continuous surface-to-surface mating. The hinge plate 42 also has a smooth upper support surface 44 adjacent to the hinge section 40 for solid mating engagement with the opposing lower surface of the outer spacer section 30. The hinge member 37 is secured to the outer spacer section 30 by bolts 45 or the like to bring the front support surface 43 into firm underlying engagement with the inner glass pane 24 across the transverse width of the inner spacer and support section 25c to obtain maximum support across an optimum glass area. It should be noted that no clamping action is effected across the entire glass panel 17, and the outer glass pane 23 is simply carried on the framing structure of the spacer and sealing means 25.

The rearward hinge and control section 40 of the hinge member 37 is integrally formed from the front section 41 with an enlarged centrally disposed hinging boss 46 having a horizontally extending bore 47 to accommodate the hinge pin 38. The boss 46 extends upwardly or outwardly above the plane of the support surfaces 43, 44 of the hinge plate 42 to locate the horizontal hinging axis of the glass front panel 17 below the outer glass pane 23 and generally in the plane of the top wall 15 and the glass panel unit 27 in its closed position. The rearward section 40 preferably defines a bell crank arrangement with the hinge pin 38 as the fulcrum and having an outer downwardly sloping lever arm 48 with a horizontal bore 49 in its outer end to accommodate the hinging pivot pin 50 for mounting one end of a control cylinder 51 for counteracting the weight of the panel 17 when in a raised position.

The hinge bracket 36 for mounting the hinge member 37 and the control cylinder 51 therefor, includes a main structural support strut or beam 53 located below the top wall 15 of the cabinet frame and preferably having its rearward end anchored securely to the top of a vertical strut 20 in order to translate the weight of the glass front unit 17 (in its raised position) into the main frame and lower section 11 of the cabinet 10 independently of any adjacent top wall or rear wall structure. The forward end of the hinge bracket 36 is constructed and arranged to support the main hinge pin 38 in fixed spaced relation in front of the top wall 15 for mounting the hinge member 37 and upper glass panel end in the plane thereof. In a present form, the hinge bracket 36 has a U-shaped front section 54 formed on the rearward strut section 53, and the vertical forward or outer wall 55 of this section 54 has a bore 56 in its upper end which aligns with the bore 47 of the hinge member 37 and receives the hinge pin 38 as with a press fit. The vertical recess 57 of the U-shaped section 54 accommodates the rear overhang 34 of the outer glass pane 23 during upward opening movement of glass front panel 17.

The control cylinder 51 has its forward end hinged by the pin 50 within a side recess of the lever arm 48, and its other end is hinged by another pin 58 secured to project out from the side of the hinge bracket strut 53. The control cylinder 51 and its function are generally known for the purpose of facilitating the raising and lowering of the glass front panel 17 and maintaining its raised position during servicing of the merchandiser, cleaning the glass panes, stocking the shelves or the like. Such control cylinders 51 are generally pneumatic, with an internal piston (not shown) movable on a piston rod 59 relative to the cylinder body (51). In the present embodiment, the location of the cylinder pivot pins 50 and 58 are constructed and arranged to mount the cylinder 51 with its forward end angled slightly downwardly from horizontal so that the downward swinging movement of the lever arm 48 during upward opening of the glass front panel 17 requires a minimum additional downward pitch to the cylinder as the piston rod 59 is drawn outward by its hinged connection on pin 50 to charge the cylinder 51. It will be noted that the cylinder 51 is attached by pivot pin 58 to the structural beam 53 of the hinge means 22 and has no direct or indirect attachment to the cabinet structure except through the strut means 20 as described.

The front edge of the top wall 15 may be provided with a small resilient seal 60 having an outwardly projecting flexible sealing lip 61 against which the free marginal edge 32 of the outer glass pane 23 can be engaged when in the closed position (FIG. 3) of the merchandiser. In moving to its open position (FIG. 4), it will be seen that the free marginal edge 32 is carried downwardly into the bracket recess 57 and away from the sealing lip 61, although the lip may be flexed upwardly against the outer surface of pane 23 in the open position of FIG. 4. Although only a single hinging means 22 has been described, it is clear that such means is typically used in pairs secured adjacent to the curved side margins 27 of the glass panels 17. It will be noted in FIG. 2 that a dual hinge bracket member 36A is used in intermediate location between adjacent glass panels 17A and 17B to support and align the respective right-hand and left-hand hinge members 37A and 37B therefor.

Thus, it has been shown that the rearward projection or overhang 33 of the outer glass pane 23 covers the hinge means 22 and presents an all-glass appearance blending directly into the exterior surface of the top wall 15 with a negligible interruption. The invention contemplates further enhancing this all-glass appearance by employing a silk-screen opaque masking 62, which is applied as a frit and cured to fuse into the interior surface of the outer glass pane 23 through the transverse glass area extending from the overhang area 33 substantially to the curve line "r—r" to obscure the upper bar member 25*c*. The inner surface of the overhang 33 is also sealed with a protective anti-shatter coating (not shown) to thereby protect the projecting lip (33) of the outer glass 23 from scattering glass fragments in case of breakage.

Figure 8:
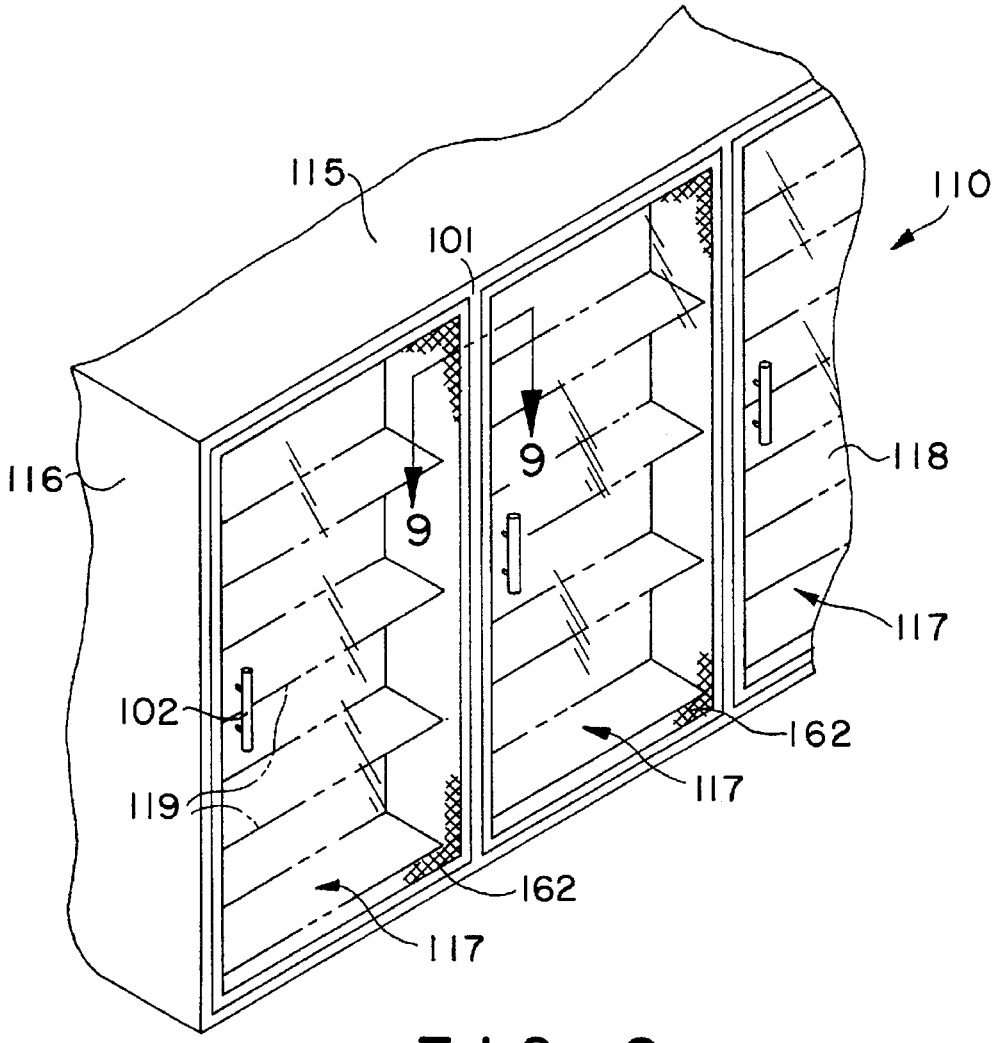
FIG. 8 is a perspective view illustrating another application of the present invention in a glass front reach-in merchandiser.
Figure 9:
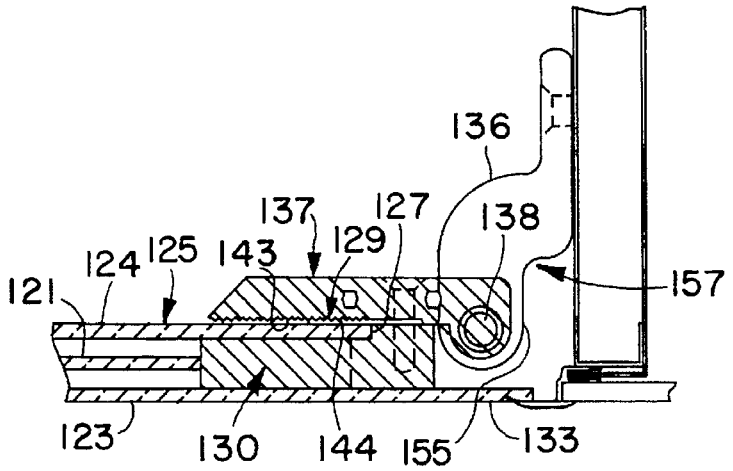
FIG. 9 is an enlarged fragmentary sectional view along line 9—9 of FIG. 8.

Referring now to FIGS. 8 and 9, it will be seen that the invention may be applicable to vertical hinging arrangements as in a glass front reach-in merchandiser 110, which typically comprises a series of identical side-by-side display compartments or zones 118 having vertically disposed shelves 119. The merchandiser cabinet 110 is generally defined by top and side walls 115 and 116 that may have a peripheral front trim molding 101. Each compartment 118 is normally closed by a glass front panel 117 in the form of a hinged door with a handle 102.

Reach-in merchandisers are often used in the display of frozen foods and ice cream at low product temperatures in the range of −20° F. to 0° F. Therefore, as shown in FIG. 9, each glass front panel 117 will typically have a three pane construction—an outer pane 123, an inner pane 124 and an intermediate pane 121—with spacing and sealing means 125 constructed and arranged to accommodate the triple glass structure. As shown, a double spacer bar frame will be employed but an outer bar section 130 may be employed to span between projecting marginal areas 129 and 133 of the inner and outer glass panes 124 and 123, respectively, so that the weight of the glass front panel 117 is translated from this bar section 130 into the hinging means 122 and the merchandiser cabinet. Thus, the vertical marginal spacer bar member 130 at the hinge side extends beyond and holds the edge 129 of the inner pane 124, and the hinge member 137 provides a wide supporting platen 143 for the inner glass marginal area while being carried or mounted securely to the projecting front support bar surface 144. The hinge bracket 136 has a front or outer wall 155 with a hinge pin 138 located in the plane of the glass panel margin, and also defines a recess 157 inwardly thereof to accommodate the inward swinging movement of the overhang 133 of the outer glass pane 123.

From the foregoing, it will be seen that a heavy duty hinge structure and novel seal arrangement is provided for glass front panels 17, 117 of refrigerated merchandisers 10, 110 as well as hot food merchandisers similar to the merchandiser of FIG. 1. The hinge fully supports the glass panel without exerting opposing clamping forces thereon, and the larger hinge configuration is obscured by the opaque masking material that blends with the color of the seals and top wall to present an all-glass exterior appearance. It will be understood that the present invention covers such changes and modifications that may become apparent to those skilled in the art and which are within the scope of the appended claims.

What is claimed is:

1. A food merchandiser having a cabinet with a controlled temperature product zone normally closed by at least one glass front panel having a hinging side margin, said glass front panel including an outer glass pane having one peripheral edge along the hinging side margin and a structural frame member secured in inwardly spaced relation to the one peripheral edge of the glass pane along the hinging side margin thereof, and hinge means directly connecting the structural frame member to the cabinet and being constructed and arranged for hinging opening movement of the glass front panel to access the product zone, and said one peripheral edge being constructed and arranged to extend over and hide the hinge means when said glass front panel is in its closed position with the merchandiser cabinet, and sealing means constructed and arranged for sealing engagement along the one peripheral edge of the glass pane hinging side margin in the closed position of the glass front panel.

2. The merchandiser of claim 1, in which said hinge means comprises a hinge member having a support and attachment section for supporting engagement with the glass front panel and attachment to the structural frame member, and a hinge bracket member secured to the merchandiser cabinet and being constructed and arranged to translate the weight of the glass front panel to the cabinet when the panel is opened.

3. The merchandiser of claim 1, including masking means along the one peripheral edge of the glass front panel to obscure the hinge means.

4. The merchandiser of claim 3, in which said masking means is applied to said outer glass pane over the structural frame member.

5. The merchandiser of claim 1, in which said glass front panel further includes an inner glass pane secured in inwardly spaced relation with the outer glass pane by the structural frame member along the hinging side of the panel, said structural frame member extending beyond the edge of the inner glass pane, and said hinge means including a hinge member having a hinge plate section in surface supporting contact with the inner glass pane and having an adjacent section rigidly attached to the extended portion of the structural frame member.

6. The merchandiser of claim 5 which is of the refrigerated or heated deli-display type and has a cabinet top member for hingedly accommodating the hinging side margin of the glass front panel for vertical upward opening movement of the glass front panel on a horizontal hinge axis, and said hinge means comprises a hinge bracket member secured to the cabinet and providing the horizontal hinge axis for pivotally mounting the hinge member.

7. The merchandiser of claim 5 which is of the reach-in display type and has a vertical cabinet side member hingedly accommodating the hinging side margin of the glass front panel for horizontal side opening movement of the glass front panel on a vertical hinge axis, and said hinge means comprising a hinge bracket member secured to the cabinet and providing the vertical hinge axis for pivotally mounting the hinge member.

8. The merchandiser of claim 6, in which the glass front panel includes at least two separately hinged side-by-side sections with adjacent opposed inner side margins, and sealing means constructed and arranged on at least one of said inner side margins for sealing engagement with the other inner side margin in the closed position of said panel sections with the merchandiser cabinet.

9. The merchandiser of claim 8, in which said sealing means comprises a resilient seal member having a base for attachment along the panel side margin of the inner glass pane, and flexible hollow gasket means extending laterally outwardly from said base, said gasket means being constructed and arranged for bending movement and compression between the adjacent opposed inner side margins of the panel sections in the closed position thereof.

10. The merchandiser of claim 9, in which said resilient seal member is provided on each of the panel sections to normally extend toward each other and cooperatively form a dual seal in which the gasket means of one of said seal members will be disposed in compressed sealing relation between said opposed inner side margins and the gasket means of the other seal member will be contacted and compressed by the base of said one seal member.

11. The merchandiser of claim 9, in which said panel sections each have an outer side margin normally disposed opposite to an adjacent opposed surface of a cabinet wall, and said resilient seal member is also constructed and arranged for sealing engagement between the outer side margins of said panel sections and the adjacent opposed cabinet wall surfaces.

12. A glass panel assembly swingably mounted at one edge for opening and closing movement relative to the front of a merchandiser cabinet comprising:

a glass front panel having plural outer and inner glass panes disposed in side-by-side spaced relation and a structural frame sealably interposed between said glass panes to provide a sealed air space therebetween, said structural frame including a frame member disposed adjacent to the peripheral edges of said glass panes along said one edge of the assembly with a portion of said frame member extending outwardly beyond the peripheral edge of the inner glass pane, hinge means directly connected to the extended portion of the metal frame member and being constructed and arranged for supporting said structural frame and glass panes for swinging movement relative to the merchandiser cabinet, and the outer glass pane having its peripheral edge extending outwardly beyond said metal frame member and hiding said hinge means therebehind.

13. The merchandiser of claim 12, in which said hinge means comprises a hinge member having a support and attachment section for attachment to the frame member, and a hinge bracket member secured to the merchandiser cabinet and being constructed and arranged to translate the weight of the glass front panel to the cabinet when the panel is opened.

14. The merchandiser of claim 12, including masking means along the one peripheral edge of the glass front panel to obscure the hinge means.

15. The merchandiser of claim 14, in which said masking means is applied to said outer glass pane over the structural frame member.

16. The merchandiser of claim 12, in which said inner glass pane is secured in inwardly spaced relation with the outer glass pane by the frame member along the hinging side thereof and said frame member extends beyond the edge of the inner glass pane, and said hinge means including a hinge member having a hinge plate section in surface supporting contact with the inner glass pane and having an adjacent section rigidly attached to the extended portion of the frame member.

17. The merchandiser of claim 16 which is of the refrigerated or heated deli-display type and has a cabinet top member for hingedly accommodating the hinging side margin of the glass front panel for vertical upward opening movement of the glass front panel on a horizontal hinge axis, and said hinge means comprises a hinge bracket member secured to the cabinet and providing the horizontal hinge axis for pivotally mounting the hinge member.

18. The merchandiser of claim 16 which is of the reach-in display type and has a vertical cabinet side member hingedly accommodating the hinging side margin of the glass front panel for horizontal side opening movement of the glass front panel on a vertical hinge axis, and said hinge means comprising a hinge bracket member secured to the cabinet and providing the vertical hinge axis for pivotally mounting the hinge member.

19. The merchandiser of claim 17, in which the glass front panel includes at least two separately hinged side-by-side sections with adjacent opposed inner side margins, and sealing means constructed and arranged on at least one of said inner side margins for sealing engagement with the other inner side margin in the closed position of said panel sections with the merchandiser cabinet.

20. The merchandiser of claim 19, in which said sealing means comprises a resilient seal member having a base for attachment along the panel side margin of the inner glass pane, and flexible hollow gasket means extending laterally outwardly from said base, said gasket means being constructed and arranged for bending movement and compression between the adjacent opposed inner side margins of the panel sections in the closed position thereof.

21. The merchandiser of claim 20, in which said resilient seal member is provided on each of the panel sections to normally extend toward each other and cooperatively form a dual seal in which the gasket means of one of said seal members will be disposed in compressed sealing relation between said opposed inner side margins and the gasket means of the other seal member will be contacted and compressed by the base of said one seal member.

22. The merchandiser of claim 19, in which said panel sections each have an outer side margin normally disposed opposite to an adjacent opposed surface of a cabinet wall, and said resilient seal member is also constructed and arranged for sealing engagement between the outer side margins of said panel sections and the adjacent opposed cabinet wall surfaces.

23. A refrigerated merchandiser having a cabinet with a product zone normally closed by at least one glass front panel having a hinging side margin, said glass front panel including an outer glass pane with one peripheral edge defining the hinging side margin and a structural frame member secured in inwardly spaced relation to the one peripheral edge of the glass pane, and hinge means directly connecting the one structural frame member to the cabinet and being constructed and arranged for hinging opening movement from a normally closed position of the glass front panel to access the product zone, and the portion of said one peripheral edge extending beyond the structural frame member being constructed and arranged to overhang and hide the hinge means in the closed position of the glass front panel.

24. The merchandiser of claim 23, in which said merchandiser cabinet includes a solid base frame and rigid strut means constructed and arranged to carry the weight of the glass front panel and translate such weight into the cabinet base frame.

25. The merchandiser of claim 24, in which said merchandiser is of the refrigerated or heated deli-display type having its produce zone vertically disposed above the base frame, said strut means extending vertically above the base frame along one side of the product zone, and said hinge means being connected to and supported by said strut means.

26. The merchandiser of claim 25, which further comprises control cylinder means constructed and arranged between said strut means and said hinge means to counteract the weight of the glass front panel in its opened position.

27. The merchandiser of claim 25, in which said glass front panel comprises at least two separately hinged sections with adjacent opposed inner side margins and each section being formed of dual inner and outer glass panes sealed in spaced relationship, and a resilient sealing member constructed and arranged on at least one of the inner side margins for sealing engagement with the opposed inner side margin of the other panel section.

28. The merchandiser of claim 27, in which said resilient seal member is provided on each of the panel sections to normally extend toward each other and cooperatively form a dual seal in which of one of said seal members will be disposed in compressed sealing relation between said opposed inner side margins and the other seal member will be contacted and compressed by said one seal member.

29. The merchandiser of claim 27, in which said panel sections each have an outer side margin normally disposed opposite to an adjacent opposed surface of a cabinet wall, and said resilient seal member is also constructed and arranged for sealing engagement between the outer side margins of said panel sections and the adjacent opposed cabinet wall surfaces.

30. The merchandiser of claim 23, including masking means extending along at least the one peripheral edge of the outer glass pane to obscure the hinge means.

31. The merchandiser of claim 23, in which said hinge means comprises a hinge member having a support and attachment section for supporting engagement with the glass front panel and attachment to the structural frame member, and a hinge bracket member secured to the merchandiser cabinet and being constructed and arranged to translate the weight of the glass front panel to the cabinet when the panel is opened.

32. The merchandiser of claim 23, including masking means along the one peripheral edge of the glass front panel to obscure the hinge means.

33. The merchandiser of claim 32, in which said masking means is applied to said outer glass pane over the structural frame member.

34. The merchandiser of claim 23, in which said glass front panel further includes an inner glass pane secured in inwardly spaced relation with the outer one glass pane by the structural frame member along the hinging side margin of the panel, said structural frame member extending beyond the edge of the inner glass pane, and said hinge means including a hinge member having a hinge plate section in surface supporting contact with the inner glass pane and having an adjacent section rigidly attached to the extended portion of the structural frame member.

35. The merchandiser of claim 34 which is of the refrigerated or heated deli-display type and has a cabinet top member for hingedly accommodating the hinging side margin of the glass front panel for vertical upward opening movement of the glass front panel on a horizontal hinge axis, and said hinge means comprises a hinge bracket member secured to the cabinet and providing the horizontal hinge axis for pivotally mounting the hinge member.

36. The merchandiser of claim 34 which is of the reach-in display type and has a vertical cabinet side member hingedly accommodating the hinging side margin of the glass front panel for horizontal side opening movement of the glass front panel on a vertical hinge axis, and said hinge means comprising a hinge bracket member secured to the cabinet and providing the vertical hinge axis for pivotally mounting the hinge member.

37. The merchandiser of claim 35, in which the glass front panel includes at least two separately hinged side-by-side sections with adjacent opposed inner side margins, and sealing means constructed and arranged on at least one of said inner side margins for sealing engagement with the other inner side margin in the closed position of said panel sections with the merchandiser cabinet.

38. The merchandiser of claim 37, in which said sealing means comprises a resilient seal member having a base for attachment along the panel side margin of the inner glass pane, and flexible hollow gasket means extending laterally outwardly from said base, said gasket means being constructed and arranged for bending movement and compression between the adjacent opposed inner side margins of the panel sections in the closed position thereof.

39. The merchandiser of claim 38, in which said resilient seal member is provided on each of the panel sections to normally extend toward each other and cooperatively form a dual seal in which the gasket means of one of said seal members will be disposed in compressed sealing relation between said opposed inner side margins and the gasket means of the other seal member will be contacted and compressed by the base of said one seal member.

40. The merchandiser of claim 37, in which said panel sections each have an outer side margin normally disposed opposite to an adjacent opposed surface of a cabinet wall, and said resilient seal member is also constructed and arranged for sealing engagement between the outer side margins of said panel sections and the adjacent opposed cabinet wall surfaces.

41. A refrigerator display case comprising a cabinet for containing refrigerated items, said cabinet having a front opening, a plurality of window panels disposed in side-by-side relation, means supporting said panels for pivotal movement about a horizontal axis between a lowered position closing said cabinet opening and a raised position for permitting access to the interior of said cabinet through said opening, said panels each having an outer glass pane and inner glass pane, said glass panes of each panel being disposed in side-by-side relation with a spacer interposed therebetween for maintaining said glass panes in parallel relation with an air space therebetween, said spacer of each panel including a pair of side spacer members disposed between said glass panes adjacent opposite peripheral sides of the glass panes and upper and lower spacer members disposed between the glass panes adjacent upper and lower peripheral ends thereof, said upper spacer member being in the form of a pivot bar disposed partially between said outer and inner glass panes, said pivot bar having at least one hinge mounting section disposed below said outer glass pane but extending beyond the upper peripheral edge of said inner glass pane so as to define an exposed mounting surface, and said panel supporting means including at least one hinge assembly for each panel, and said hinge assembly having a pivotally mounted hinge plate secured to said exposed mounting surface of said pivot bar hinge mounting section.

42. The refrigerator display case of claim 41 in which said outer glass pane is larger in size than said inner glass pane.

43. The refrigerator display case of claim 42 in which said cabinet includes a top wall, means defining a hinge plate pivot axis in predetermined relation to said top wall, and said outer glass pane extends rearwardly over the upper peripheral edge of said inner glass pane, said pivot bar mounting section, and said pivot axis when said window panel is in the lowered closed position.

44. The refrigerator display case of claim 41 in which said outer glass pane of each window panel has a completely exposed and unobstructed outer surface free of molding, hinge hardware and external trim.

45. The refrigerator display case of claim 44 in which the outer glass pane of each window panel has masking means about peripheral marginal edge regions thereof for preventing viewing of said spacer when in the closed position while permitting substantially unobstructed viewing of the interior of the refrigerator cabinet.

46. The refrigerator display case of claim 41 including fluid controlled cylinder means connected between said hinge plate and said cabinet for facilitating and controlling movement of each panel between said lowered and raised positions.

47. The refrigerator display case of claim 46 in which said pivot bar hinge mounting sections have a greater thickness than the portion of the pivot bar disposed between said glass panes such that an underside exposed mounting surface of said hinge mounting sections are substantially flush with an inner surface of the window panel.

48. The refrigerator display cabinet of claim 47 in which said pivot plate has a forwardly extending portion overlapping an upper marginal edge region of the inner glass pane.

49. The refrigerator display case of claim 41 including at least one strip of moisture absorbing desiccant extending across each window panel between the glass panes at a location inwardly of said pivot bar.

50. The refrigerator display case of claim 41 in which said spacer bar is a solid bar.

* * * * *